United States Patent [19]

Horie et al.

[11] 3,931,813

[45] Jan. 13, 1976

[54] EXHAUST GAS RECIRCULATION CONTROL DEVICE

[75] Inventors: Masakazu Horie, Tokyo; Takao Fukuhara; Tetsuya Harada, both of Yokohama, all of Japan

[73] Assignee: Nissan Motor Company Limited, Yokohama, Japan

[22] Filed: July 25, 1973

[21] Appl. No.: 382,291

[30] Foreign Application Priority Data

July 26, 1972 Japan ..... 47-74798

[52] U.S. Cl. ..... 123/119 A

[51] Int. Cl.[2] ..... F02M 25/06

[58] Field of Search ..... 123/119 A

[56] References Cited

UNITED STATES PATENTS

| | | | |
|---|---|---|---|
| 1,502,772 | 7/1924 | Grinham | 123/119 A |
| 3,756,210 | 9/1973 | Kuehl | 123/119 A |
| 3,783,848 | 1/1974 | Ranff et al. | 123/119 A |
| 3,802,402 | 4/1974 | Swatman | 123/119 A |
| 3,834,363 | 10/1974 | Goto et al. | 123/119 A |

*Primary Examiner*—Wendell E. Burns
*Assistant Examiner*—David D. Reynolds

[57] ABSTRACT

An orifice and a valve to maintain the ratio of recirculated exhaust gas to engine intake air at an optimum level.

4 Claims, 8 Drawing Figures

RECIRCULATION RATIO
5 %
10 %
15 %
140 mmHg (EXHAUST PRESSURE Pe)
100mmHg (EXHAUST PRESSURE Pe)
60mmHg (EXHAUST PRESSURE Pe)
40 mmHg (EXHAUST PRESSURE Pe)
20mmHg (EXHAUST PRESSURE Pe)
A
B
C
INTAKE MANIFOLD VACUUM (Pb) (-mmHg)
0
100
200
300
400
500
ENGINE SPEED (r.p.m)
8
12
16
20
24
28
32
36
40 x10²

EXHAUST GAS RECIRCULATION CONTROL DEVICE

The invention relates to an exhaust gas recirculation system for an internal combustion engine, and more particularly to a device for maintaining the ratio of recirculation of exhaust gas to engine intake air at an optimum value under all operating conditions of the engine. Various prior art methods have been employed in an attempt to reduce the level of noxious nitrogen oxides emitted from an engine in response to an increase in the severity of environmental pollution laws. These methods include electronic control of fuel introduction and ignition, catalytic exhaust cleaning methods, etc. However, these approaches have proved prohibitively expensive. The cost of total redesign of the vehicle combustion chamber in order to improve the combustion efficiency thereof has prevented the application of this approach.

This invention is concerned with a much cheaper and effective method of reducing the level of nitrogen oxides contained in exhaust gases, which involves recirculating exhaust gas from an engine exhaust pipe back to an engine intake manifold. This method has been accompanied in the past with the unsolved problem of maintaining the ratio of recirculated exhaust gas to engine intake air at an optimum value throughout the widely varying operating conditions of the engine.

It is thus an object of the invention to provide a control device for an exhaust gas recirculation system which overcomes the disadvantages of the prior art by effectively maintaining the ratio of recirculated exhaust gases at an optimum value throughout all operating conditions of an internal combustion engine, and is economical and easy to manufacture.

This and other objects and advantages of the invention will become clear with reference to the following description and the accompanying drawings in which.

Figure 1:
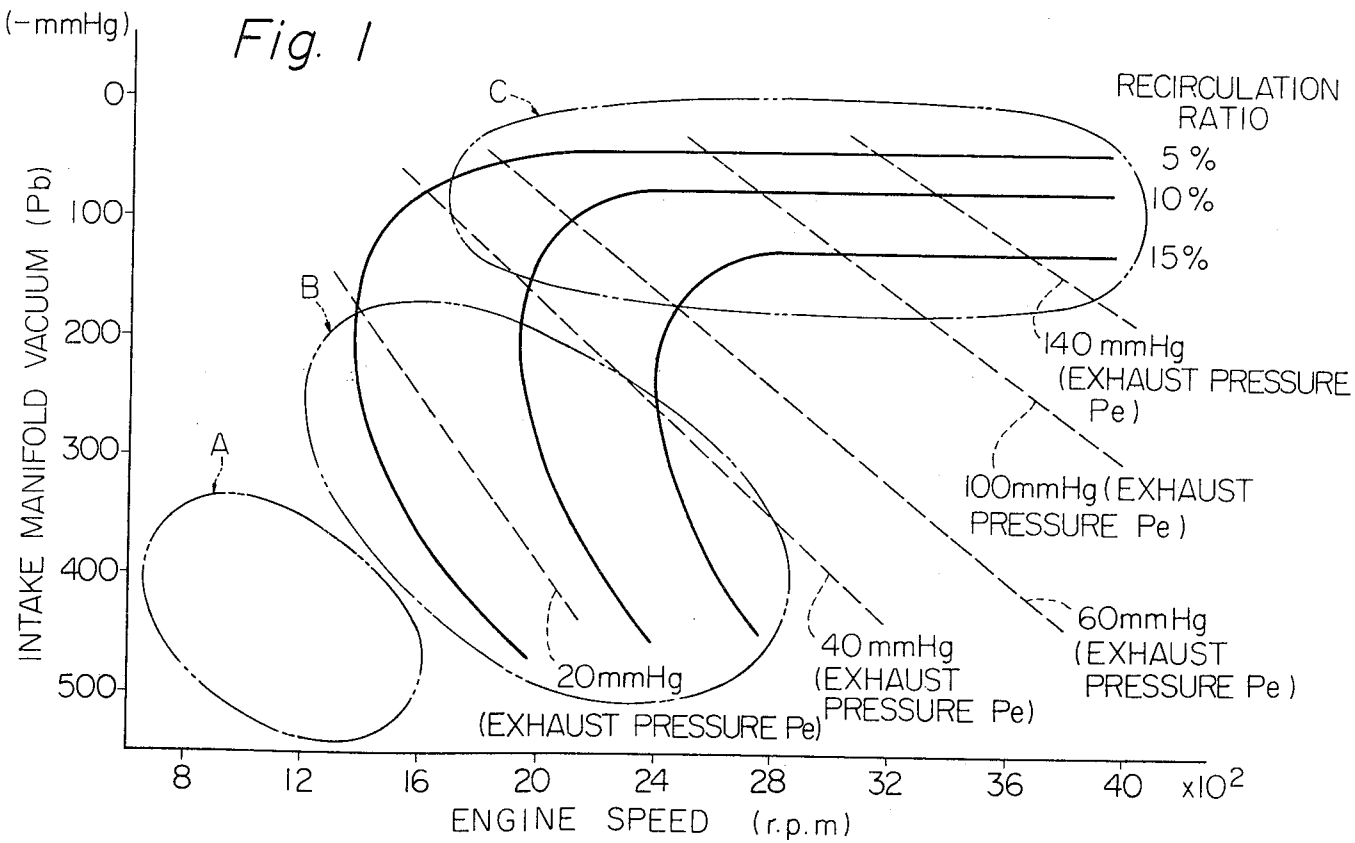
FIG. 1 shows the relationship between the exhaust gas pressure, exhaust gas recirculation ratio, engine speed, and intake manifold vacuum for a typical internal combustion engine.

Referring now to FIG. 1, there is shown the experimentally determined relationship between the engine speed and intake manifold vacuum of a typical internal combustion engine. Two families of curves are plotted on the graph; the family shown in solid line indicates the variation of intake manifold vacuum at various constant values of exhaust gas recirculation ratio, and the family shown in broken line the variation thereof for various constant values of exhaust gas pressure.

FIG. 1 also includes 3 areas, A, B and C, as shown by closed curves, which indicate low, medium, and high load engine operation respectively. Although the recirculation ratio of exhaust gas must be varied continuously to provide an optimum value as the load on the engine changes, for the sake of simplicity of explanation, engine operation in the areas A, B and C will generally be discussed discretely.

Figure 2:
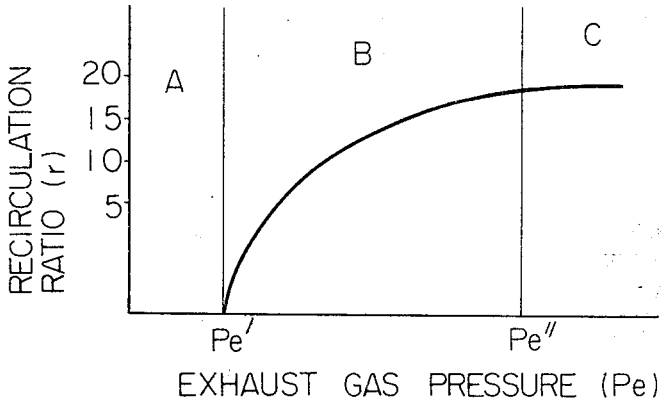
FIG. 2 shows the relationship between the exhaust gas pressure and an ideal exhaust gas recirculation ratio based on the conditions of engine operation shown in FIG. 1.

FIG. 2 is based on FIG. 1, and shows in a simplified manner the ideal volumetric recirculation ratio of exhaust gas as a function of exhaust gas pressure. It is understood that in FIG. 2 the exhaust gas pressure is a complex function of engine speed and intake manifold vacuum, and is therefore indicative of these conditions. In FIG. 2, the areas A, B and C of FIG. 1 are also shown. Under low engine load conditions as shown in the region A (low engine speed and high intake manifold vacuum), the recirculation ratio should be maintained close to zero, because the level of nitrogen oxides contained in exhaust gas under this condition is very low, and introduction of exhaust gas into the intake manifold would reduce the performance of the engine. In the region C, which represents high load engine operation (high engine speed and low intake manifold vacuum), the recirculation ratio should be maintained at a constant level to optimize the high speed operating performance of the engine. In the region B, which indicates medium load engine operation (intermediate engine speed and intake manifold vacuum), the ideal recirculation ratio rises from zero to the constant value based on the actual prevailing conditions. Thus, a device to maintain the recirculation ratio at an optimum value throughout all engine operating conditions must satisfy the conditions shown in FIGS. 1 and 2.

Figure 3:
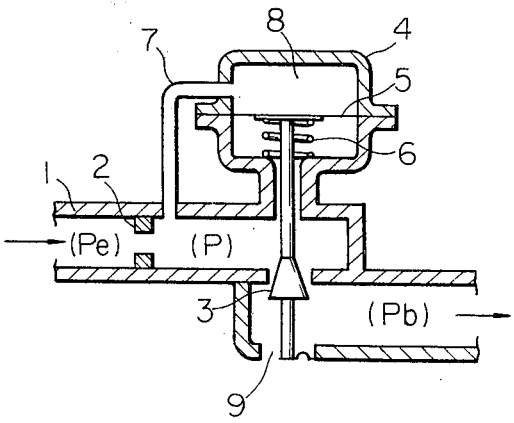
FIG. 3 is a longitudinal sectional view of an embodiment of an exhaust gas recirculation control device of the invention.

FIG. 3 shows an embodiment of an exhaust gas recirculation control device of the invention which fulfills these conditions, and which comprises in combination an orifice or a restrictor and a pressure sensitive valve, in which;

*Pe* is the pressure in the exhaust pipe of an engine (exhaust gas pressure) upstream of the control device.

*P* is the pressure existing between the orifice and valve of the embodiment of the invention.

*Pb* is the intake manifold vacuum.

*qe* is the volumetric flow rate of exhaust gas through a recirculation pipe 1 connected between the exhaust pipe and the intake manifold of an engine (not shown) such that exhaust gas flows from the exhaust pipe therethrough into the intake manifold in a direction as shown by the arrows.

*Qa* is the volumetric flow rate of intake air from the atmosphere into the intake manifold, and $C_1$ and $C_2$ are constants.

Based on these definitions, it is possible to further define a volumetric ratio ($r$) of recirculated exhaust gas ($qe$) to engine intake air ($Qa$) (the exhaust gas recirculation ratio mentioned before) as $$r = qe/Qa \quad (1)$$

Since an ideal value of $r$ depends on the flow rate $qe$, is also a function of the exhaust gas pressure $Pe$ which is in turn a function of the intake manifold vacuum and other complex engine operating conditions as mentioned above, it is possible to adjust $r$ to an optimum value by modulating the flow rate $qe$.

The prevailing flow rate $qe$ is sensed at an orifice or restrictor 2 located upstream of a valve 3 which is controlled in accordance with the sensed flow rate $qe$. For ease of explanation, the flow rate $qe$ may expressed in a simplified manner as follows:

$$qe = A \cdot C_1 \sqrt{Pe - P}$$

where $A$ is the cross sectional area of the orifice 2. The flow rate $Qa$ may be expressed as:

$$Qa = C_2 \sqrt{Pe}$$

Thus, the recirculation ratio $r$ may be re-expressed as:

$$r = \frac{C_1}{C_2} \cdot A \cdot \frac{\sqrt{Pe - P}}{\sqrt{Pe}} \qquad (2)$$

As is understood by those skilled in the art, if the ratio of the cross sectional area of the pipe 1 to that of the orifice 2 is relatively high, $P < Pe$, and equ. (2) may be reduced to $$r = \frac{C_1}{C_2} \cdot A \cdot \frac{\sqrt{Pe}}{\sqrt{Pe}} = \frac{C_1}{C_2} \cdot A \qquad (3)$$

Thus, the recirculation ratio $r$ under unrestricted flow conditions is proportional to the cross section A.

The operation of the control device of FIG. 3 will now be described with relation to FIG. 2 and the above equations. Exhaust gas entering the pipe 1 passes through the orifice 2 and the valve 3 and is recirculated back to the intake manifold. A pipe 7 is connected at one end to the pipe 1 downstream of the orifice 2 to sense the pressure $P$, and at the other end to a chamber 8 of a valve housing 4. A diaphragm or membrane 5 divides the housing 4 into the chamber 8 and another chamber (no numeral) in which is received a spring 6. The lower chamber may be vented to the atmosphere. An upper end of the valve 3 is attached to the diaphragm 5. The spring 6 biases the diaphragm 5 upwards as shown, and thus biases the valve 3 to a closed position.

If the valve 3 is closed, the pressure $P$ will equal the exhaust pressure $Pe$ since the flow rate $qe$ through the pipe 1 is zero. Thus, the valve 3 will remain closed and the flow rate $qe$ zero until the exhaust pressure $Pe$ reaches a value high enough that its action on the diaphragm 5 is sufficient to overcome the force of the spring 6. At that point, the valve 3 will begin to open. The spring 6 has a stiffness such that it will yield when the exhaust pressure $Pe$ reaches a value $Pe'$ as shown in FIG. 2. Thus, the recirculation ratio $r$ will be maintained at zero within the region A as desired.

If the exhaust pressure $Pe$ reaches the value $Pe''$ as shown in FIG. 2, the valve 3 will be completely opened, and the flow rate $qe$ will be substantially uninfluenced thereby. However, since the area A of the orifice 2 is a desired small value, as is understood by those skilled in the art, the phenomenon of choked flow through the pipe 1 will result. Thus, the recirculation ratio $r$ will be held in dependence on the value of A at a substantially constant value in the region C as desired.

Since the pressure rise in the chamber 8 continuous as the exhaust pressure $Pe$ increases as shown in FIG. 2, the valve 3 will open in a continuous manner to provide the desired performance in the region B, varying from zero from the region A to the substantially constant value in the region C. Thus, the exhaust recirculation control device of FIG. 3 is capable of effectively maintaining the recirculation ratio $r$ at an optimum value under all varying engine operating conditions as shown in FIG. 2.

In actual application of the device of FIG. 3, it has been determined that the intake manifold vacuum $Pb$ in the pipe 1 downstream of the valve 3 exerts a force on the downstream face of the valve 3 thus biasing it toward an open position against the force of the spring 6. Since this is an undesirable secondary effect, another diaphragm 9 is attached to the bottom of the valve 3 such that external atmospheric pressure acting on the bottom of the diaphragm 9 against the vacuum acting on its top biases the valve 3 upwards against the vacuum force acting on the downstream face of the valve 3. The stiffness of the diaphragm 9 is selected so that the upward force it exerts on the valve 3 is equal to the downward force exerted on the valve 3 by $Pb$.

Figure 4:
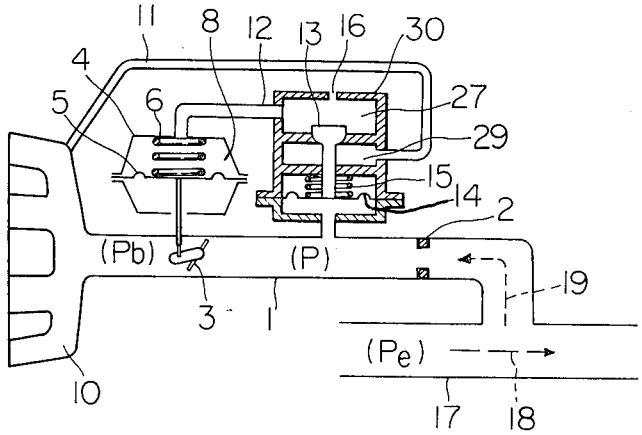
FIG. 4 is a longitudinal sectional view of a major portion of an exhaust gas recirculation system of an internal combustion engine and another embodiment of an exhaust gas recirculation control device of the invention employed therein.

The embodiment of the invention shown in FIG. 4 utilizes another method of compensating for the vacuum $Pb$ in the downstream section of the pipe 1. Like reference numerals designate like parts, although the FIG. 3 assembly of a pressure responsive unit comprising numerals 4, 5, 6 and 8 now becomes a vacuum responsive unit. As shown, exhaust gas passes through an exhaust pipe 17 in the direction of an arrow 18. A portion of it enters the pipe 1 in the direction of an arrow 19. Another diaphragm or membrane 14 which is attached to a valve 13 is biased downwards as shown by a spring 15 so as to bias the valve 13 to a closed position. The bottom of the diaphragm 14 communicates with the pipe 1 downstream of the orifice 2. The valve 13 controls communication between a first and a second chamber 27 and 29 respectively of a housing 30. The second chamber 29 is connected to an intake manifold 10 of an engine through a pipe 11. The first chamber 27 is vented to the atmosphere through a hole 16, and is also connected through a pipe 12 to the chamber 8 of the housing 4.

In this embodiment, the valve 3 is a butterfly valve, and is thus uninfluenced by vacuum $Pb$ in the downstream section of the pipe 1. In operation, until the pressure $Pe$ reaches the level $Pe'$, the valve 13 is biased closed by the spring 15 and the valve 3 is biased closed by the spring 6. As the value of $Pe$ exceeds $Pe'$, the valve 13 is opened by the pressure $P$ acting on the diaphragm 14 and vacuum $Pb$ communicates with the first chamber 27 through the valve 13. When the valve 13 is opened to an extent that the flow rate of atmospheric air through the valve 13 exceeds that through the hole 16, the pressure in the first chamber 27 will drop below atmospheric, and this vacuum will act on the diaphragm 5 to open the valve 3. Operation is otherwise the same as that of the embodiment of FIG. 3 except that when the valve 13 is closed, the pressure in the first chamber 27 is returned to atmospheric by air entering therein through the hole 16.

In actual operation of a device of the invention, it has been observed that there occur under certain conditions pulsations of considerable magnitude in the value of $Pb$, which tend to produce unstable operation of the device. This effect is most prevalant with engines having a small number of cylinders and at high values of $Pb$. The embodiment shown in FIG. 5 is similar to that of FIG. 4 and like numerals indicate like elements, but the embodiment of FIG. 5 contains an additional feature which eliminates the effects of pulsations in *Pb*.

Figure 5:
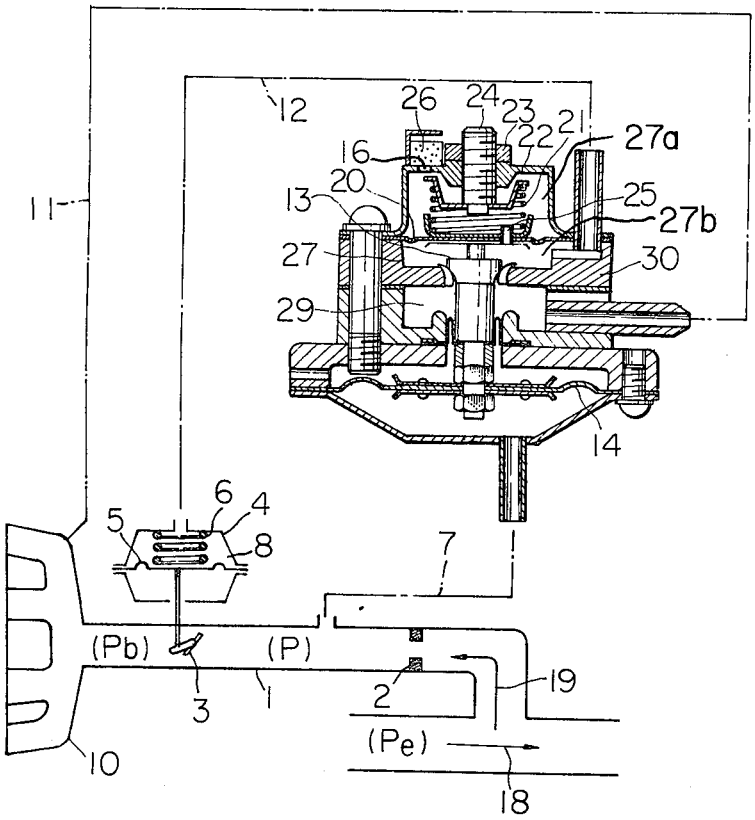
FIG. 5 is similar to FIG. 4 but shows a third embodiment of the invention.

In FIG. 5, an additional diaphragm or membrane 20 is provided within the first chamber 27, which has a hole 25 formed through it. Also, a filter 26 is provided for the hole 16. The diaphragm 20 divides the first chamber 27 into a atmospheric chamber 27*a* which communicates through the hole 16 with the atmosphere and a vacuum chamber 27*b* which communicates through the pipe 12 with the chamber 8 of the valve housing 4. Communication between the first chamber 27 and the atmosphere is established through the holes 20 and 16. The bottom of the diaphragm 20 engages with the top of the valve 13, and the diaphragm 20 and the valve 13 are biased downward as shown to a closed position of the valve 13 by a spring 21, which replaces the spring 15 of FIG. 4. The effective force of the spring 21 may be adjusted by means of an adjusting screw 24, and lock nut 23 which vertically set the position of a seat 22 for the spring 21.

In operation, intake manifold vacuum *Pb* is introduced into the second chamber 29 through the pipe 11. If the valve 13 is closed, vacuum *Pb* is prevented from communicating with the first chamber 27 and thus the chamber 8, and pulsations in *Pb* have no effect on the operation of the valve 3, which is closed. In the embodiment of FIG. 4, if the valve 13 is open, *Pb* is communicable with the chamber 8 to actuate the valve 3, and pulsations in *Pb* may produce undesirable oscillation of the valve 3. However, in the embodiment of FIG. 5, atmospheric air enters the first chamber 27 through the holes 16 and 25. Since a constant flow is set up, a vacuum *Pc* prevails in the first chamber 27 which is lower in value than the intake manifold vacuum *Pb*. It can be seen that due to this flow and the effect of the diaphragm 20, pulsations in *Pb*, are not directly transmitted to the chamber 8, but are reflected in gradual variations in the value of *Pc*. Thus, the diaphragm 20 produces a dampening or dashpot effect, and pulsations in *Pb*, especially of high frequency and at high values of *Pb*, are prevented from being transmitted to the chamber 8 to produce oscillation of the valve 3.

Adjustment of the effective force of the spring 21 and consequently the preset opening load of the valve 13 can be made using the adjusting screw 24. Adjustment of the damping effect of the diaphragm 20 can be accomplished by varying the cross-sectional areas of the diaphragms 14 and 20 and the holes 16 and 25. If the force exerted on the diaphragm 14 by the pressure *P* (a function of the pressure *Pe* as described before) is $S_A \cdot P$ where $S_A$ is the area of the diaphragm 14, and the force exerted on the diaphragm 20 by the vacuum *Pb* is $S_B \cdot Pb$ where $S_B$ is the area of the diaphragm 20, under equilibrium conditions $$S_A \cdot P = S_B \cdot Pb \quad (4)$$

and $$Pc = \frac{S_A}{S_B} \cdot P \quad (5)$$

Thus, the value of *Pc* in terms of *P* and thus the damping performance of the diaphragm 20 is reflected in the ratio $S_A/Sb$.

Figure 6:
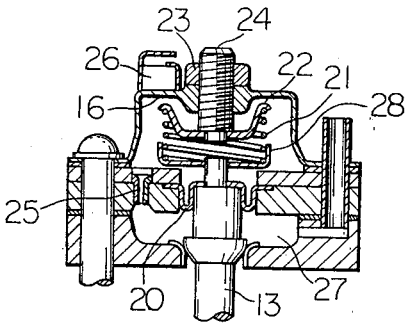
FIG. 6 is a longitudinal cross sectional view of a modification of the embodiment of the control device shown in FIG. 5.

If it is desired to maximize the damping effect of the diaphragm 20, it may be reduced in diameter to substantially the diameter of the valve 13, as shown in the embodiment of FIG. 6, in accordance with the ratio $S_A/S_B$. Here, the hole 25 is formed in the housing 30 as shown, rather in the diaphragm 20, and the spring 21 engages with a retainer 28 secured to the valve 13.

Figure 7:
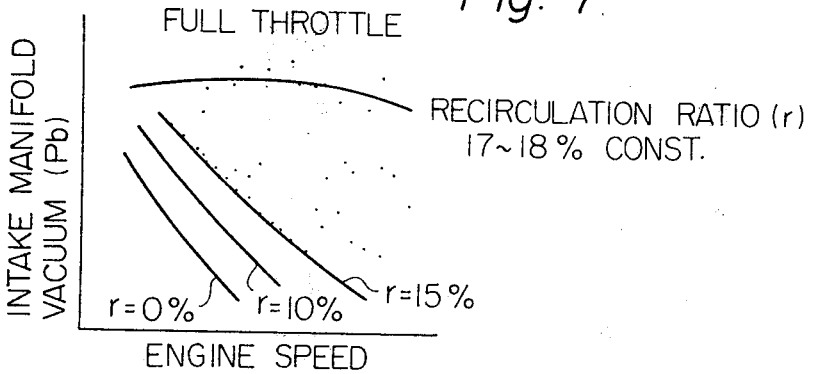
FIG. 7 shows the exhaust gas recirculation characteristics of the device shown in FIG. 3.
Figure 8:
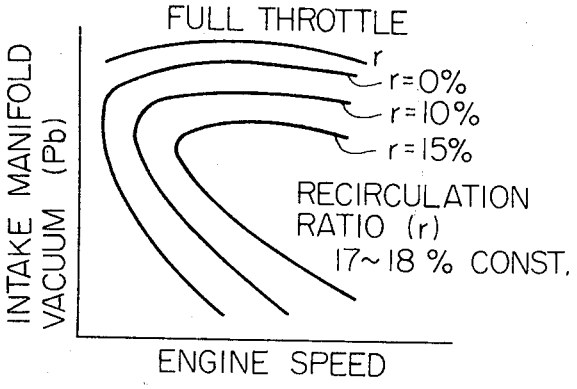
FIG. 8 shows the recirculation characteristics of the devices shown in FIGS. 4 through 6.

FIGS. 7 and 8 are experimental graphs of the recirculation ratios provided by the embodiment of FIG. 3 and the embodiments of FIGS. 4 to 6 respectively. They are included for reference to demonstrate that an exhaust gas recirculation control device of the invention is capable of recirculating exhaust gas from an engine exhaust pipe back to an intake manifold at an ideal ratio throughout all engine operating conditions in order to minimize the emission of noxious nitrogen oxides from an engine without impairing its performance.

What is claimed is:

1. An exhaust gas recirculation control device for use in an internal combustion engine having an intake manifold, an exhaust pipe and an exhaust gas recirculation pipe connecting said intake manifold to said exhaust pipe, said control device being operatively connected to said recirculation pipe and comprising:

an exhaust gas flow restrictor in said recirculation pipe;

an exhaust gas flow control valve mounted downstream of said restrictor;

a pressure responsive membrane arranged to communicate with said recirculation pipe between said restrictor and said flow control valve to respond to pressure generated therebetween;

a housing divides into a first chamber having an air bleed hole and a second chamber by a wall having a valve seat;

a valve normally seated on said valve seat to block communication between the first and second chambers, and fixedly connected to said pressure responsive membrane, said valve being biased by a spring, the stiffness of said spring being selected such that when a predetermined pressure is reached to act on said pressure responsive membrane, said spring yields and said valve begins to open, and when the pressure acting on said pressure responsive membrane gradually increases above and beyond said predetermined pressure, the degree of opening of said valve is gradually increased;

a diaphragm having a hole, disposed within the first chamber and dividing the first chamber into an atmospheric chamber communicating with the atmosphere through the air bleed hole and a vacuum chamber communicating with said atmospheric chamber through the hole, said diaphragm being engaged with said valve, said diaphragm preventing transmission of oscillations in the level of intake manifold vacuum to a vacuum responsive membrane and said flow control valve by dampening said oscillations;

a said vacuum responsive membrane communicated with said vacuum chamber of said first chamber and linked with said flow control valve;

the arrangement being such that when said predetermined pressure and pressures above and beyond said predetermined pressure act on said pressure responsive membrane, said valve leaves said valve seat causing intake manifold vacuum to communicate through said valve with said vacuum chamber of said first chamber and said air bleed hole and when air sucked through said air bleed hole reaches a predetermined maximum flow level, said intake manifold vacuum acts on said vacuum responsive membrane to open said flow control valve in dependence on the pressure level acting on said pressure responsive membrane.

2. A device as claimed in claim 1, wherein said air bleed hole is provided with an air filter.

3. A device as claimed in claim 1, wherein said second recited valve is mounted between said pressure responsive membrane and said vacuum responsive membrane.

4. A device as claimed in claim 1, wherein said spring is disposed in said atmospheric chamber of said first chamber and mounted between said diaphragm and a seat connected to an adjusting screw.

* * * * *